US005762002A

United States Patent [19]

Dahlin et al.

[11] Patent Number: 5,762,002

[45] Date of Patent: Jun. 9, 1998

[54] COVER FOR OPEN TOP RAIL CAR

[75] Inventors: William G. Dahlin; William S. Pladson, both of Fargo, N. Dak.

[73] Assignee: M-Bar-D Railcar Tech., Inc., Fargo, N. Dak.

[21] Appl. No.: 778,849

[22] Filed: Jan. 6, 1997

Related U.S. Application Data

[63] Continuation-in-part of Ser. No. 54,375, May 13, 1996, Pat. No. Des. 387,308.

[51] Int. Cl.[6] ..... B61D 39/00

[52] U.S. Cl. ..... 105/377.02; 296/98

[58] Field of Search ..... 105/377.01, 377.02, 105/377.03; 296/98, 100, 217; 160/238; 220/1.5

[56] References Cited

U.S. PATENT DOCUMENTS

| | | | |
|---|---|---|---|
| D. 251,660 | 4/1979 | Low . | |
| 894,759 | 7/1908 | Stevens . | |
| 1,186,388 | 6/1916 | Fountain . | |
| 2,562,300 | 7/1951 | Dingman | 296/98 |
| 3,330,225 | 7/1967 | Barry . | |
| 3,366,414 | 1/1968 | Thompson et al. | 105/377.02 |
| 3,829,154 | 8/1974 | Bechnell | 296/98 |
| 4,003,301 | 1/1977 | Norton . | |
| 4,162,100 | 7/1979 | Muscillo . | |
| 4,302,043 | 11/1981 | Dimmer et al. . | |
| 4,435,010 | 3/1984 | Mandel . | |
| 4,484,777 | 11/1984 | Michel . | |
| 4,505,512 | 3/1985 | Schmeichel et al. . | |
| 4,585,267 | 4/1986 | Friesen . | |
| 4,691,957 | 9/1987 | Ellingson . | |
| 4,821,648 | 4/1989 | Bramhall et al. . | |
| 4,823,707 | 4/1989 | Salsbury et al. . | |
| 5,050,923 | 9/1991 | Petelka | 296/98 |
| 5,180,203 | 1/1993 | Goudy . | |
| 5,190,341 | 3/1993 | Simard . | |
| 5,218,743 | 6/1993 | Miller | 296/98 |
| 5,271,336 | 12/1993 | Willetts . | |
| 5,328,228 | 7/1994 | Klassen | 296/98 |
| 5,393,117 | 2/1995 | Beale . | |

*Primary Examiner*—Mark T. Le
*Attorney, Agent, or Firm*—Burd, Bartz & Gutenkauf

[57] ABSTRACT

An open top railroad car is equipped with end caps that allow air to flow into and out of the car chamber. A tarp extended between the end caps covers the open top of the car. A roll tube is secured to one longitudinal side of the tarp. A manually operated crank attached to the roll bar with a flexible cord is used by a yardperson to selectively roll the tarp to it's open and closed positions. A plurality of straps joined to the roll tube are connected to winches operable to hold the tarp in it's closed position.

21 Claims, 5 Drawing Sheets

COVER FOR OPEN TOP RAIL CAR

CROSS REFERENCE TO RELATED APPLICATION

This application is a continuation-in-part of U.S. application Ser. No. 29/054,375 filed May 13, 1996, now U.S. Pat. No. Des. 387,308.

FIELD OF THE INVENTION

The invention relates to apparatus for selectively covering open top railroad cars or gondola cars that carry particulate materials and weather-sensitive products. The apparatus particularly relates to roll-up covers and end caps that allow an operator to open and close the covers from a ground position and allow the load in the railroad car to be dispensed without opening the cover.

BACKGROUND OF THE INVENTION

Open top railroad cars are used to haul weather-sensitive products, including iron ore, coal, grain, bulk plastic, fly ash, sand and crushed rock ballast. The products in open top railroad cars are subject to rain, snow, sleet, ice and transit erosion. Fine products, such as fly ash and sand, are subject to blow-off, which can deteriorate the environment. Yardperson and railroad workers using known covers for open top railroad cars must work between the cars and climb on the cars to open and close the covers. This is time and labor consuming, as well as hazardous, work. Examples of covers for open top railroad cars shown by Salisbury et al, in U.S. Pat. No. 4,823,707 and Bobale, in U.S. Pat. No. 5,393,117. These covers cannot be opened and closed by an operator located on the ground adjacent the side of the cars. The loads in the cars cannot be effectively dumped with the covers in their closed positions over the tops of the cars.

SUMMARY OF THE INVENTION

The invention relates to a cover for an open top rail car that allows a load in the rail car to be dumped from the rail car with the cover in the closed position. The cover includes end caps that are mounted on opposite ends of the rail car in spaced relationship relative to the walls of the rail car to allow air to flow into and out of the rail car to allow air to flow into and out of the rail car chamber. A tarp extended between the end caps covers the open top of the rail car. The tarp is manually movable to an open position to allow a load to be placed into the rail car chamber. The tarp is manually moved from the open position to its closed position and secured to the rail car prior to transport to a selected destination. The tarp prevents blow-off of the load material from the rail car chamber and protects the load from rain, snow, sleet, ice and transit erosion. A crank operatively coupled to the tarp is used by a yardperson located laterally of the rail car to roll the part to the open position and unroll the tarp to the closed position. The yardperson is not positioned between adjacent rail cars when operating the crank to move the tarp between its open and closed positions.

The preferred embodiment of the rail car cover has end caps mounted on opposite ends of an open top rail car. Each end cap has a top wall upwardly directed arcuate second section. Lips project downwardly from first and second sections adjacent the sidewalls and an end wall of the rail car. Brackets secured to the sidewalls and end wall of the rail car attach the end caps to the rail car. The brackets space the lips from adjacent portions of the rail car to allow air to flow under the end caps into and out of the car chamber. A flexible tarp extends between the end caps has opposite ends that rest on the arcuate second section of the top wall when the tarp is in the closed position. The tarp also is supported on cross members or bows mounted on opposite sidewalls of the rail car. One longitudinal edge of the tarp is secured to one sidewall of the rail car. The opposite longitudinal edge accommodates a roll bar. A crank handle connected to one end of the roll bar with a flexible cable to allow a yardperson to turn the crank handle when located adjacent one side of the rail car. The crank handle is turned in one direction to toll the tarp in the roll bar to move the tarp from the closed position to the open position. Turning the crank handle in the opposite direction unrolls the tarp over the cross member from the open position to the closed position over the open top of the rail car. A tarp biasing assembly has a coil spring operatively connected to the tarp with a cords to assist in moving the tarp from the open position to the closed position. A plurality of straps secured to the longitudinal edge of the tarp accommodating the roll bar are releasably attached to the rail car sidewall with latches to hold the tarp in the closed position. The latches are ratchet devices that are operable to place the straps and tarp in tension to firmly retain the tarp in the closed position. de

DESCRIPTION OF PREFERRED EMBODIMENT

Figure 1:
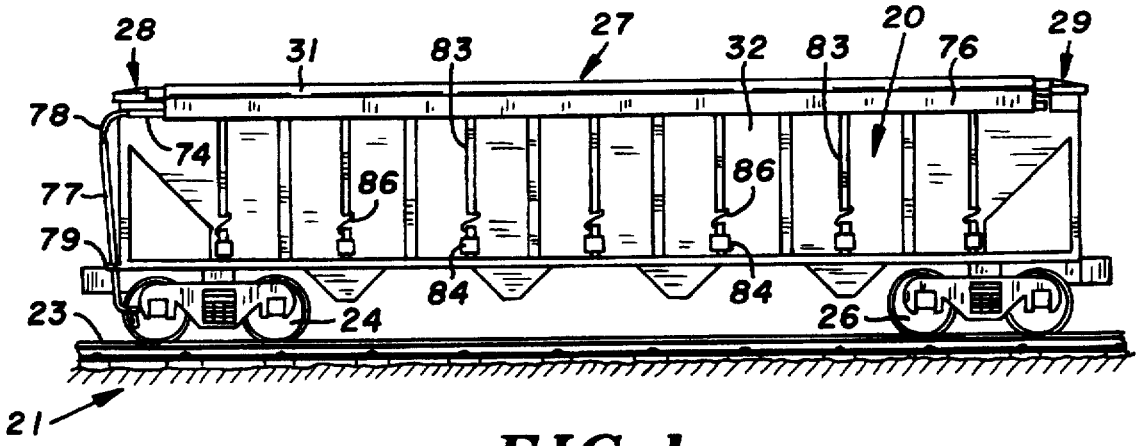
FIG. 1 is a side elevational view of an open top rail car equipped with the roll cover and end caps of the invention.
Figure 2:
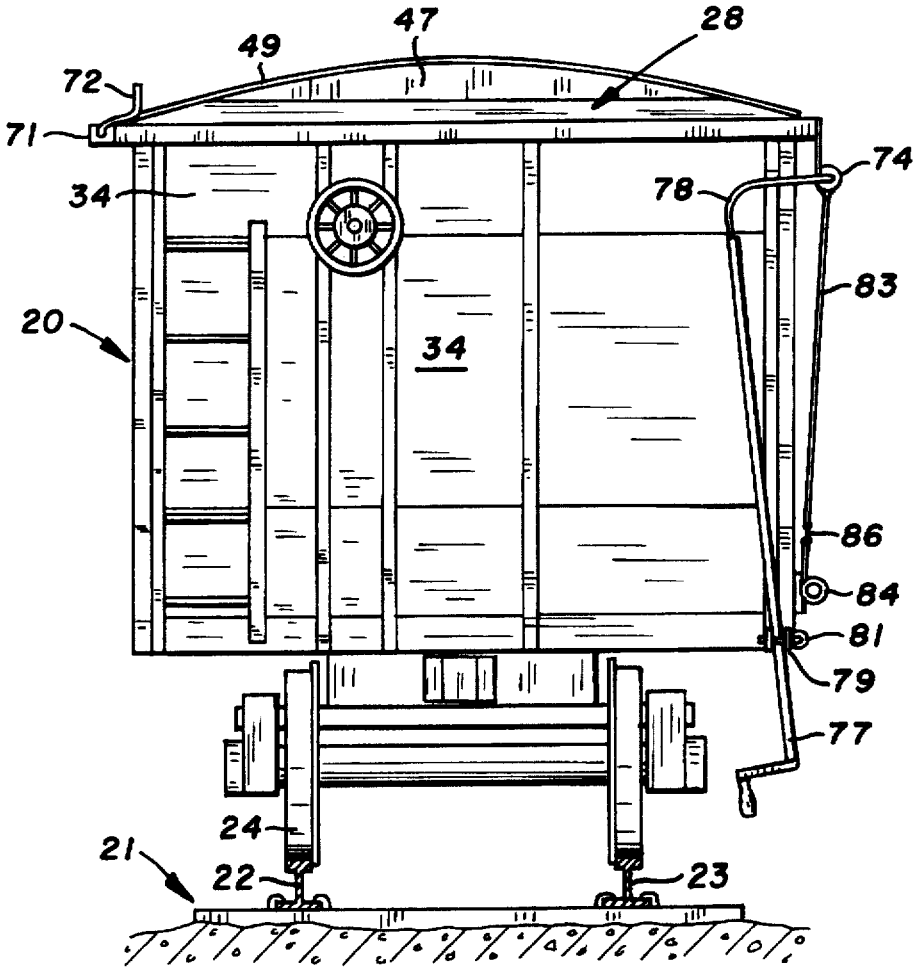
FIG. 2 is an enlarged end elevational view of the left end of the rail car, roll cover and left end cap of FIG. 1.
Figure 3:
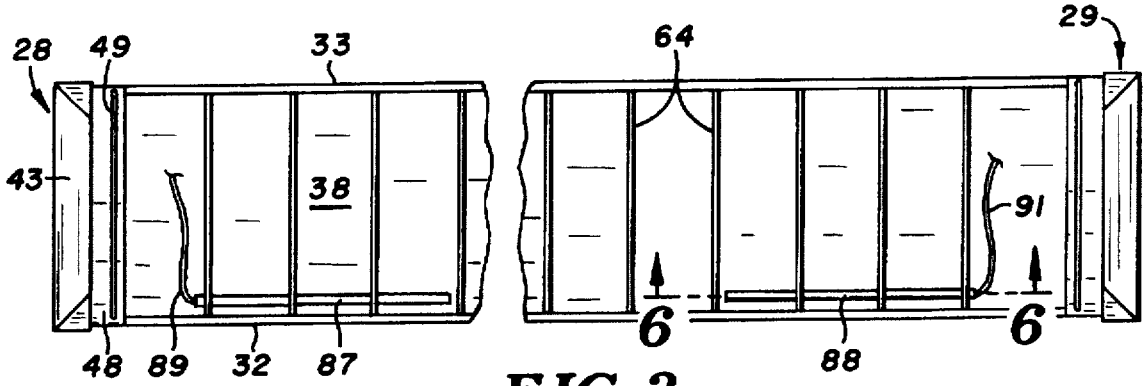
FIG. 3 is a foreshortened top plan view of the rail car equipped with transverse bows and end caps without the roll cover.
Figure 4:
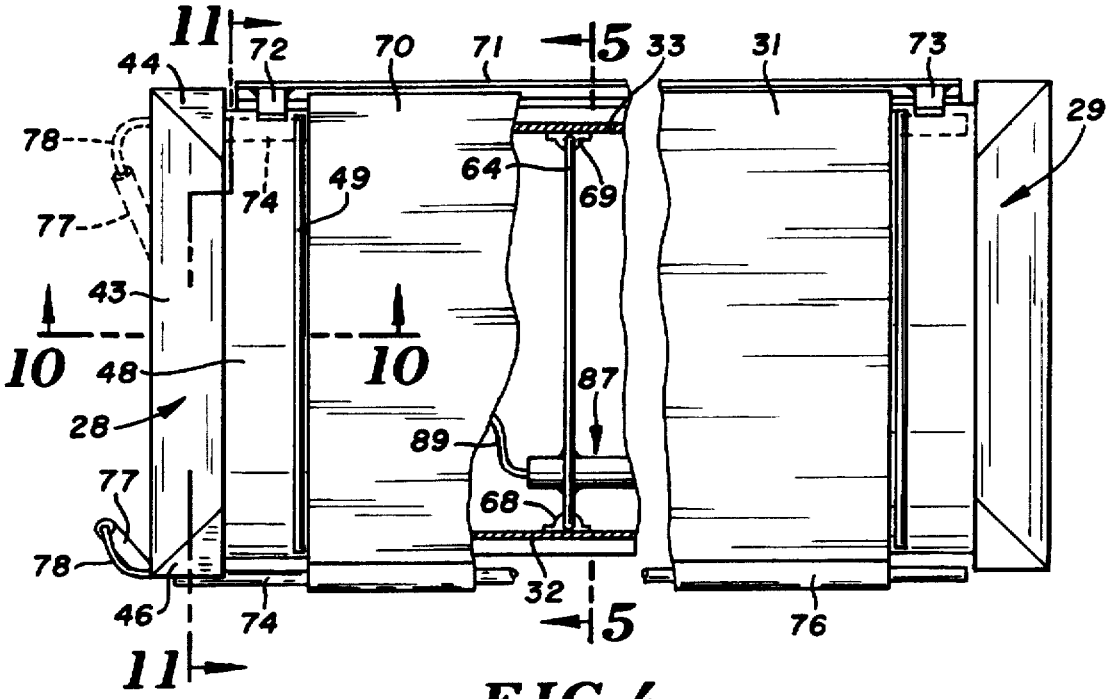
FIG. 4 is a foreshortened top plan view of the rail car showing the roll cover in the closed position.
Figure 10:
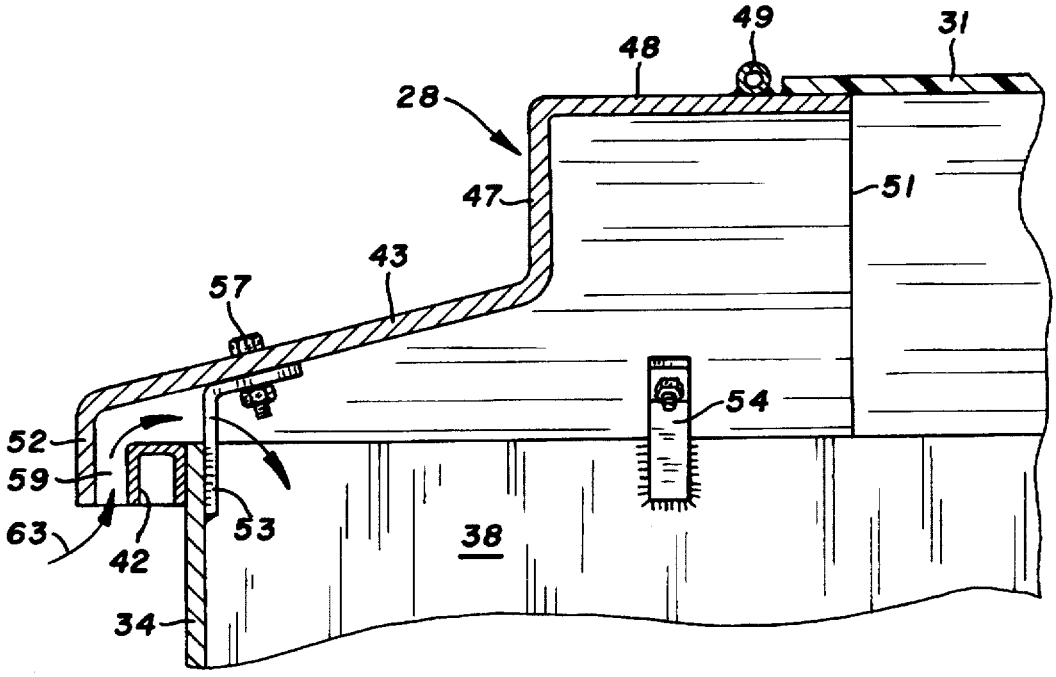
FIG. 10 is an enlarged sectional view taken along line 10—10 of FIG. 4.

Referring to FIGS. 1 and 2, there is shown an open top railroad railway car 20 for transporting bulk materials equipped with the roll cover indicated generally at 27 and end caps 28 and 29 of the invention. Car 20 is a conventional railroad car or gondola used to transport particular materials and weather sensitive products including but not limited to grain, coal, ore, plastic beads, sand, and fly ash. Car 20 has a pair of trucks 24 and 26 having wheels that ride on rail 22 and 23. Rails 22 and 23 are located along a railroad way 21. Cover 27 includes a roll-up tarp 31 extended between end caps 28 and 29. Tarp 31 is a flexible sheet of fiber reinforced plastic. Other types of sheet material can be used for tarp 31. Car 20 shown in FIGS. 3 and 5, has a longitude upright side walls 32 and 33 joined to transverse upright end walls 34 and 36. The car has a bottom 37 with a plurality of downwardly directed hoppers. The side walls and bottom form a chamber or compartment for accommodating bulk materials. The outer upper peripheral edges of side walls 32 and 33 have inverted channel members 39 and 41, as seen FIG. 5. The inverted channel members 42, shown in FIG. 10, extend transversely across the upper outer edges of end walls 34 and 36.

Figure 11:
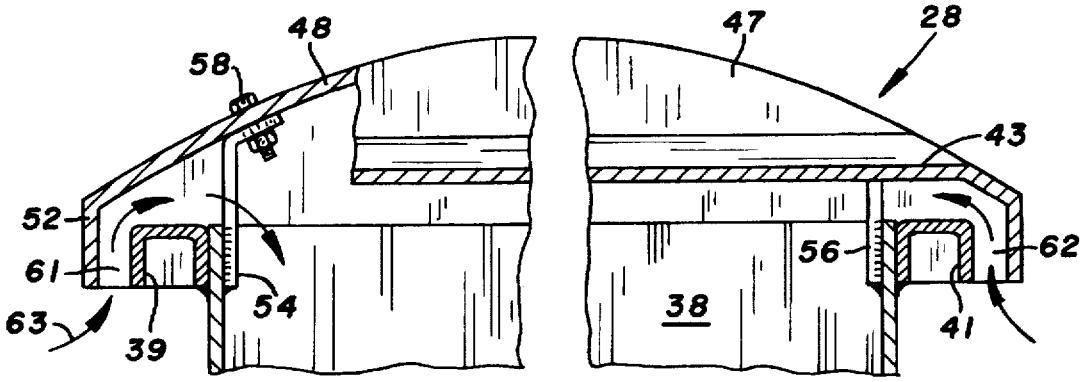
FIG. 11 is an enlarged sectional view taken along line 11—11 of FIG. 4.
Figure 12:
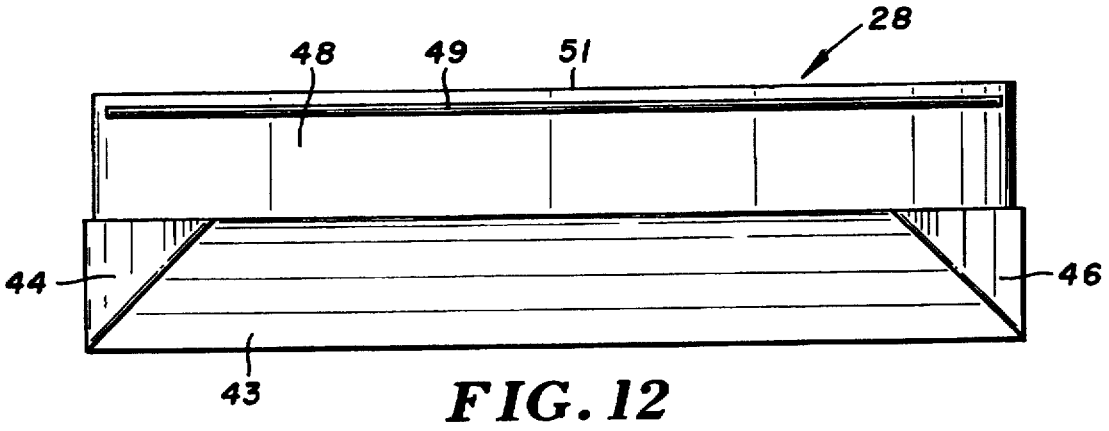
FIG. 12 is a top plan view of an end cap.
Figure 13:
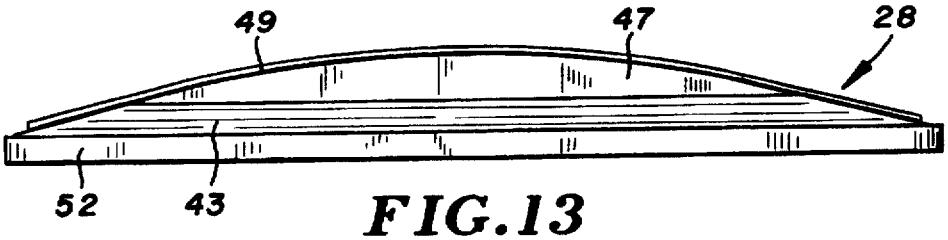
FIG. 13 is a front elevational view of the end cap of FIG. 12.
Figure 14:
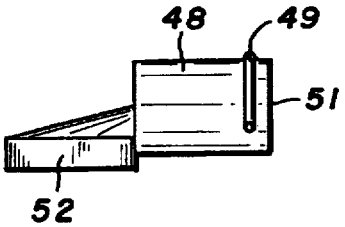
FIG. 14 is a side elevational view of the end cap of FIG. 12.
Figure 15:
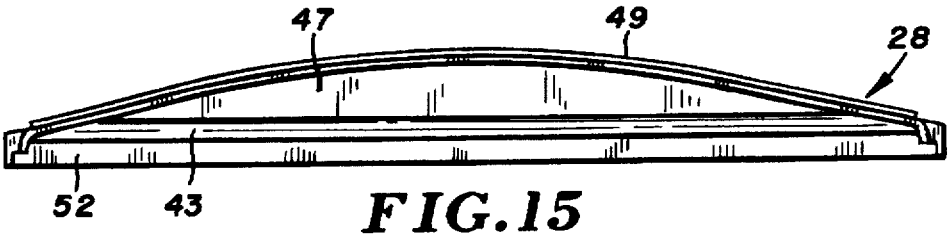
FIG. 15 is a rear elevational view of the end cap of FIG. 12.
Figure 16:
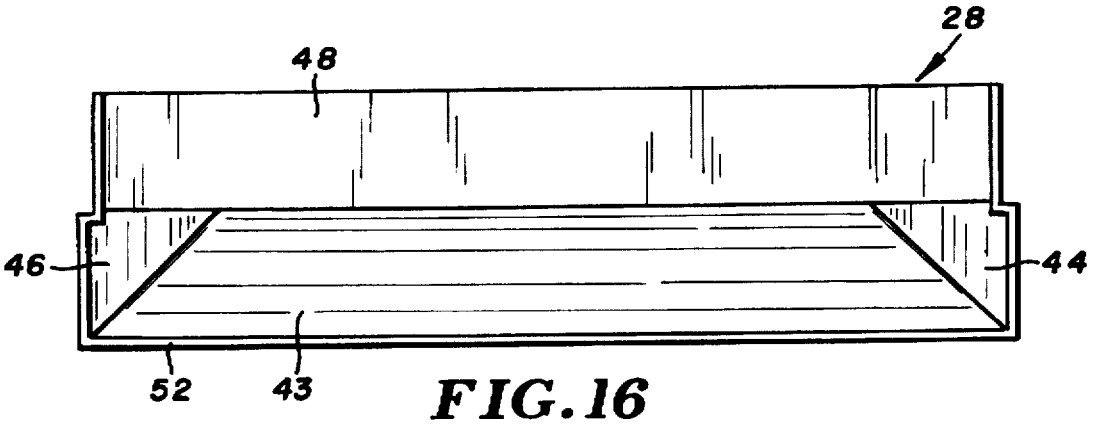
FIG. 16 is a bottom plan view of the end cap of FIG. 12.

End caps 28 and 29 are identical in structure. End cap 28 is mounted on the left end of car 20 as seen in FIG. 1. End cap 29 is mounted on the opposite end of car 20. Following description is directed to end cap 28. As shown in FIGS. 12 to 16, end cap 28 has a stepped top wall comprising a first downwardly and forwardly slopping portion 43 having outwardly and downwardly directed ends 44 and 46. The inside edges of wall 43 are joined to upright wall 47 having an arcuate curved top edge joined to a curved second top wall portion 48. An arcuate rod or tube 49 is secured to the top of wall portion 48 outwardly from its inner end 51. Wall portion 43 has a downwardly directed continuous lip 52 spaced outwardly from channel members 39, 41, and 42, seen FIGS. 10 and 11, to prevent water, ice and snow from flowing into chamber 38. The outwardly spaced lip 52 provides a front transverse passage 59 and lateral side passages 61 and 62 from the outside environment to chamber 38 of car 20. Arrows 63, shown in FIGS. 10 and 11, indicated a flow of air under cover 28 into chamber 38 of car 20. Air is free to flow into and out of chamber 38 through passages 59, 61 and 62. This allows the material contained in car chamber 38 to be dumped from the car without removing or opening tarp 31. Air is free to flow into chamber to replace the volume of material moving downwardly out of car chamber 38. Cap 28 in mounted on car 20 with a plurality of upright brackets 53, 54 and 56. Nut and bolt assemblies 57 and 58 secure cap 28 to brackets 53, 54 and 56 and retain cap 28 in spaced relation relative to channel members 39, 41 and 42 to ensure the flow of air into chamber 38. Lip 52 extends downwardly adjacent the outside of inverted channel member 42 to prevent water, snow and ice from blowing into car chamber 38 and prevent wind erosion of the material in car chamber 38.

Figure 7:
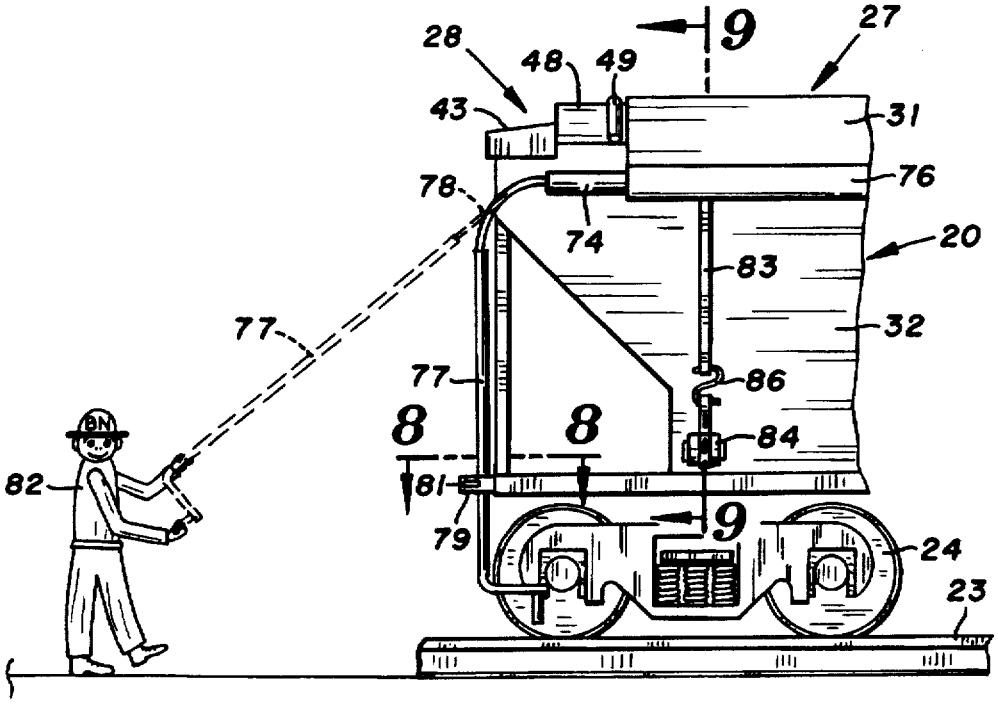
FIG. 7 is a side elevational view of a rail car end showing the roll cover and hand crank for opening and closing the roll cover.
Figure 9:
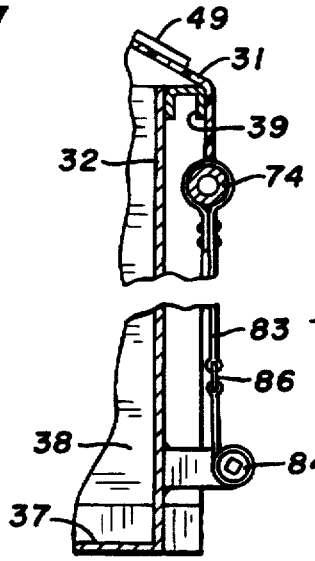
FIG. 9 is an enlarged foreshortened sectional view taken along line 9—9 of FIG. 7.

Tarp 31 is held in the closed position with a plurality of straps 83 and manual operated ratchets 84. Eye hooks 86 couple the free ends of straps 83 to ratchets 84, as shown in FIGS. 7 and 9, mounted on car side wall 32. Ratchets 84 are conventional winch structures having releasable latches that hold straps 83 under tension to maintain tarp 31 on bars 64. The upper ends of straps 83 are looped around a roll bar or tube 74 at spaced intervals along tube 74 to allow the straps 83 to be rolled up with tarp 31 when tarp 31 is rolled to the open position.

When tarp 31 is to be rolled up, ratchets 84 are released allowing hooks 86 to be uncoupled from the ratchet strap. Crank 77 is turned counter clockwise by yardperson 82 to roll up tarp 31 and straps 83 into a cylindrical rolled tarp 86 lodged against stops 72 and 73.

Figure 5:
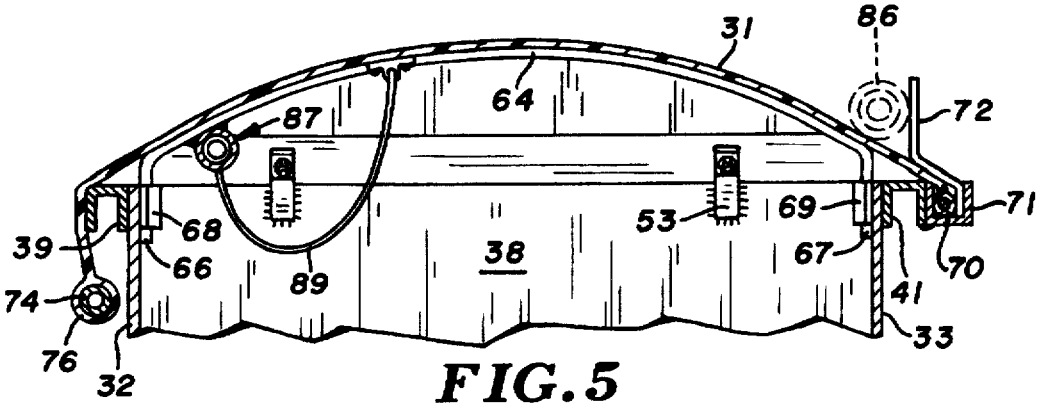
FIG. 5 is an enlarged sectional view taken along line 5—5 of FIG. 4.
Figure 6:
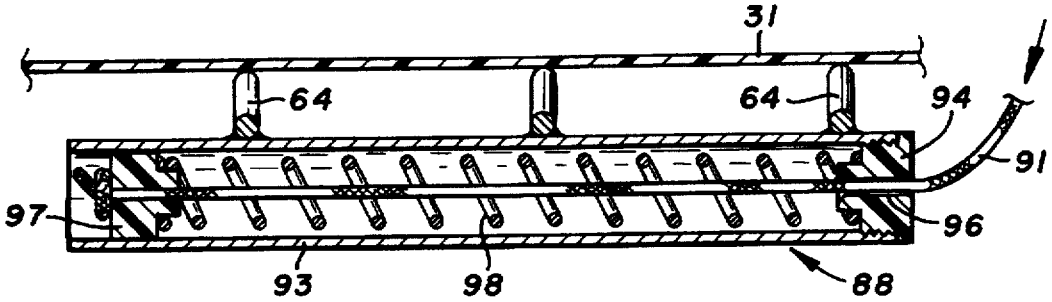
FIG. 6 is an enlarged sectional view taken along line 6—6 of FIG. 3.

A plurality of convex curved or bowed rods 64 longitudinally spaced along the top of car 20 support tarp 31 between end caps 28 and 220. As shown in FIG. 5, opposite ends 66 and 67 of rod 64 are connected to mounts 68 and 69 attached to car sidewalls 32 and 33. Rods 64 extend transversely across the top of car 20 above the load in rail car chamber 38.

One longitudinal edge 70 of tarp 31 is anchored in a channel member 71 secured to member 41. Fasteners (not shown) secure tarp 31 to member 71. Channel member 71 also supports upright stops 72 and 73 that retain tarp 31 in the roll-up open position as shown in broken lines in FIG. 5.

Figure 8:
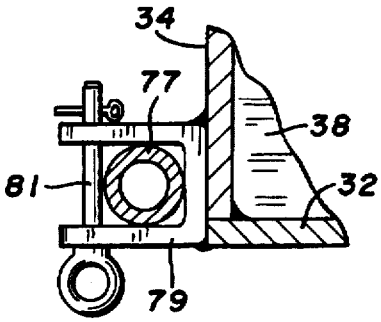
FIG. 8 is an enlarged sectional view taken along line 8—8 of FIG. 7.

A longitudinal roll bar or tube 74 is connected to the opposite longitudinal edge 76 of tarp 31. Tarp edge 76 in looped around tube 74. Fasteners (not shown) attach tarp 31 to tube 74 so that rotation of tube 74 about it's longitudinal axis in one direction will roll-up tarp 31 on tube 74 and unroll tarp from tube 74 on rotation in the opposite direction. An elongated crank 77, shown in FIGS. 2 and 7, is joined to one end of tube 74 with a flexible cable 78. Crank 77 is retained in an upright transport position with a U-shaped holder 79 and pin 81. As shown in FIG. 8, holder 79 is secured to the right front corner of car wall 34. In use, yardperson 82, removes pin 81 from holder 79 to release crank 77 from holder 79. Crank 7 is then moved away from car 20 and laterally or to the outside of car 20 so that yardperson 82 is not between adjacent cars. Yardperson 82 is in a position where he/she can be observed by railroad operators. Flexible cable 78 allows yardperson to laterally move crank 77 and rotate crank 77 to roll tarp 31 on rods 64 and end caps 28 and 29 between open and closed positions relative to the top of car 20.

Crank 77 is turned clockwise to roll tarp 31 from the rolled tarp 86 to the tarp closed position. A pair of tarp biasing assemblies 87 and 88 having flexible cords 89 and 91 attached to tarp 31 assist in moving tarp 31 over bars 64 toward the closed position. Tarp biasing assemblies 87 and 88 are identical in structure and function. The following description is directed to tarp biasing assembly 88. Assembly 88 has an elongated tube 93 secured to rods 64. A plug 94 mounted on one end of tube 93 has a central hole 96 accommodating cord 91. Cord 91 is attached to a slide block 97 located within tube 93. A coil spring 98 biases slide block 97 away from plug 94 and applying a pulling force on cord 91 thereby assisting the unrolling of the tarp 31.

In use, end caps 28 and 29 are mounted on opposite ends of the top of car 20. The side walls or lips 52 of each end cap 28 and 29 are spaced from adjacent car walls to allow air to flow into and out of the car chamber 38. During unloading or dumping of the load from the car chamber 38 air flows into chamber 38 as the level of the load drops. Tarp 31 is not rolled to it's open position during the unloading of the load from car chamber 38.

Crank 77 is used by yardperson 82 to roll tarp 31 and straps 83 between the open and closed positions. Flexible cord 78 permits lateral movement of crank 77 so that yardperson 82 can turn crank 77 to roll tarp 31 between open and closed positions from the side of car 20. Yardperson 82 is not between adjacent cars when turning crank 77.

Tarp 31 rolls on bars 64 and end caps 28 and 29 as the tarp rolls up around tube 74 to it's open position. Cords 89 and 91 also roll-up in tarp 31 and pull against coil springs 98. When tarp 31 is rolled to the roll tarp 86, shown in FIG. 5, the top of car is open. Crank 77 is moved toward front end wall 34 of car 20 and place in a holder to lock tarp 31 in the open position. Material is placed in car chamber 38 providing the load.

Yardperson 82 uses crank 77 to turn tube 74 clockwise to unroll tarp 31 to close the top of car 20. Tarp biasing assemblies 87 and 88 assist in moving tarp 31 along bars 31. When tarp 31 is fully unrolled, straps 83 extend downward toward ratchets 84. Hooks 86 are then coupled to the ratchet straps. Ratchets 84 are manually turned to tighten straps 83 and tarp 31. Crank 77 is stored in an upright position, as shown in FIGS. 2 and 7, and retained in holder 79 with pin 81. Tarp 31 is maintain tight against end cap top portion 48 adjacent rod 49. Rod 49 is a barrier that prevents air from flowing under the forward end of tarp 31.

The end caps, tarp and crank for rolling the tarp between open and closed positions can be modified by one skilled in the art in accordance with the invention. The invention is defined in the following claims.

We claim:

1. An apparatus for covering the open top of a railroad car having upright sidewalls, end walls, and a chamber for holding material between said side and end walls comprising: a first end cap, means for mounting the first end cap on said sidewalls and one end wall and spacing said first end cap from the sidewalls and the one end wall to allow air to flow into and out of the chamber, a second end cap, means for mounting the second end cap on said sidewalls and the other end wall and spacing said second end cap from the side walls and the other end wall to allow air to flow into and out of the chamber, the means for mounting the first and second end caps on the sidewalls include brackets secured to the sidewalls and end caps, said brackets spacing the end caps from the sidewalls and end walls of the car whereby air can flow into and out of the chamber, a tarp extended between the first and second end caps for covering the open top of the car, said tarp having a first side portion and a second side portion, means for connecting the first side portion to one side wall of the car, roll bar means secured to the second side portion, a crank, flexible means connecting the crank to the roll bar means whereby rotation of the crank in one direction rolls the tarp about the roll bar means to open the open top of the car and rotation of the crank in the direction opposite the one direction unrolls the tarp from the roll bar means to close the open top of the car, and means for securing the second side portion of the tarp to a sidewall of the car to hold the tarp in the closed position.

2. An apparatus for covering the open top of a railroad car having upright sidewalls, end walls, and a chamber for holding material between said side and end walls comprising: a first end cap, means for mounting the first end cap on said sidewalls and one end wall and spacing said first end cap from the sidewalls and the one end wall to allow air to flow into and out of the chamber, a second end cap, means for mounting the second end cap on said sidewalls and the other end wall and spacing said second end cap from the side walls and the other end wall to allow air to flow into and out of the chamber, each end cap has a top wall having an upwardly inclined first section and an upwardly directed arcuate second section, an upright wall joining the first and second sections, and end walls joined to opposite ends of the first section, and downwardly projected lips joined to the first and second sections of the top wall located adjacent and spaced outwardly of the sidewalls and end wall of the car to allow air to flow into and out of the chamber of the car, a tarp extended between the first and second end caps for covering the open top of the car, said tarp having a first side portion and a second side portion, means for connecting the first side portion to one side wall of the car, roll bar means secured to the second side portion, a crank, flexible means connecting the crank to the roll bar means whereby rotation of the crank in one direction rolls the tarn about the roll bar means to open the open top of the car and rotation of the crank in the direction opposite the one direction unrolls the tarn from the roll bar means to close the open top of the car, and means for securing the second side portion of the tarp to a sidewall of the car to hold the tarp in the closed position.

3. The apparatus of claim 2 wherein: the end walls of each end cap are inwardly and upwardly inclined and joined to the upright wall.

4. The apparatus of claim 2 wherein: the second section has a top surface and an inside edge, and a member secured to the top surface spaced from the inside edge whereby an end of the tarp when in the closed position is located on the top surface between the member and inside edge.

5. The apparatus of claim 4 wherein: the member is an arcuate continuous member projected away from the top surface of the second section.

6. An apparatus for covering the open top of a railroad car having upright sidewalls, end walls, and a chamber for holding material between said side and end walls comprising: a first end cap, means for mounting the first end cap on said sidewalls and one end wall and spacing said first end cap from the sidewalls and the one end wall to allow air to flow into and out of the chamber, a second end cap, means for mounting the second end cap on said sidewalls and the other end wall and spacing said second end cap from the side walls and the other end wall to allow air to flow into and out of the chamber, each end cap has a top wall including an upwardly directed arcuate section extended between the sidewalls of the car, said section having a top surface and an inside edge, a member secured to the top surface spaced from the inside edge, a tarn extended between the first and second end caps for covering the open top of the car, said tarp having a first side portion, a second side portion, a first end and a second end, means for connecting the first side portion to one side wall of the car, roll bar means secured to the second side portion, a crank, flexible means connecting the crank to the roll bar means whereby rotation of the crank in one direction rolls the tarp about the roll bar means to open the open top of the car and rotation of the crank in the direction opposite the one direction unrolls the tarp from the roll bar means to close the open top of the car, and means for securing the second side portion of the tarp to a sidewall of the car to hold the tarp in the closed position, with the first and second ends of the tarp located on the top surfaces of the end caps between the members and inside edges.

7. The apparatus of claim 6 wherein: the member is an arcuate continuous member projected away from the top surface of the second section.

8. The apparatus of claim 6 wherein: the means for mounting the first and second end caps on the sidewalls include brackets secured to the sidewalls and end caps, said brackets spacing the end caps from the side walls and end walls of the car whereby air can flow into and out of the chamber.

9. The apparatus of claim 6 including: a tarp biasing means for biasing the tarp toward the closed position and assist in unrolling the tarp from the roll bar means.

10. The apparatus of claim 9 including: upwardly extended arcuate members located transversely over the top of the car to support the tarp in the closed position, means mounting the member on the sidewalls of the car, said biasing means comprising a tubular member secured to the members, a spring located within the tubular member, means to anchor one end of the spring on the tubular member, and cord means connecting the spring to the tarp whereby the spring biases the tarp toward the closed position thereof.

11. An apparatus for covering the open top of a railroad car having upright sidewalls, end walls and a chamber for holding material between said side and end walls comprising: a first end cap, means for mounting the first end cap on the sidewalls and one end wall of the car with the first end cap spaced from the one end wall to allow air to flow into and out of the chamber, a second end cap, means for mounting the second end cap on the sidewalls and the other end wall of the car with the second end cap spaced from the other end wall of the car to allow air to flow into and out of the chamber, the means for mounting the first and second end caps on the sidewalls include brackets secured to the sidewalls and end caps, said brackets spacing the end caps from the side walls and end walls of the car whereby air can flow into and out of the chamber, a tarp extended between the first and second end caps for covering the open top of the car, first means for connecting a portion of the tarp to the car, second means for moving the tarp between a closed position covering the open top of the car and an open position to open the top of the car, and third means for securing the tarp to the car to hold the tarp in the closed position.

12. The apparatus of claim 11 wherein: the second means for moving the tarp between a closed position covering the open top of the car and an open position to open the top of the car includes a hand crank and flexible means connecting the hand crank to the tarp whereby turning of the hand crank in one direction moves the tarp from the open position to the closed position and turning the hand crank in a direction opposite the one direction moves the tarp from the closed position to the open position thereof.

13. An apparatus for covering the open top of a railroad car having upright sidewalls, end walls and a chamber for holding material between said side and end walls comprising: a first end cap, means for mounting the first end cap on the sidewalls and one end wall of the car with the first end cap spaced from the one end wall to allow air to flow into and out of the chamber, a second end cap, means for mounting the second end cap on the sidewalls and the other end wall of the car with the second end cap spaced from the other end wall of the car to allow air to flow into and out of the chamber, each end cap has a top wall having an upwardly inclined first section and an upwardly directed arcuate second section, an upright wall joining the first and second sections, end walls joined to opposite ends of the first section, and downwardly projected lips joined to the first and second sections of the top wall located adjacent and spaced outwardly of the sidewalls and end wall of the car to allow air to flow into and out of the chamber of the car, a tarp extended between the first and second end caps for covering the open top of the car, first means for connecting a portion of the tarp to the car, second means for moving the tarp between a closed position covering the open top of the car and an open position to open the ton of the car, and third means for securing the tarp to the car to hold the tarp in the closed position.

14. The apparatus of claim 13 wherein: the end walls of each end cap are inwardly and upwardly inclined and joined to the upright wall.

15. The apparatus of claim 13 wherein: the second section has a top surface and an inside edge, and a member secured to the top surface spaced from the inside edge whereby an end of the tarp when in the closed position is located on the top surface between the member and inside edge.

16. The apparatus of claim 15 wherein: the member is an arcuate continuous member projected away from the top surface of the second section.

17. An apparatus for covering the open top of a railroad car having upright sidewalls, end walls and a chamber for holding material between said side and end walls comprising: a first end cap, means for mounting the first end cap on the sidewalls and one end wall of the car with the first end cap spaced from the one end wall to allow air to flow into and out of the chamber, a second end cap, means for mounting the second end can, means for mounting the second end cap on the sidewalls and the other end wall of the car with the second end cap spaced from the other end wall of the car, each end cap has a top wall including an upwardly directed arcuate section extended between the sidewalls of the car, said section having a top surface and an inside edges a member secured to the top surface spaced from the inside edge, a tarp having first and second ends extended between the first and second end caps for covering the open top of the car, first means for connecting a portion of the tarp to the car, second means for moving the tarp between a closed position covering the open top of the car and an open position to open the top of the car, and third means for securing the tarp to the car to hold the tarp in the closed position with the first and second ends of the tarp located on the top surfaces of the end caps between the members and inside edges.

18. The apparatus of claim 17 wherein: the member is an arcuate continuous member projected away from the top surface of the second section.

19. The apparatus of claim 17 wherein: the means for mounting the first and second end caps on the sidewalls include brackets secured to the sidewalls and end caps, said brackets spacing the end caps from the side walls and end walls of the car whereby air can flow into and out of the chamber.

20. The apparatus of claim 17 including: a tarp biasing means for biasing the tarp toward the closed position and assist in unrolling the tarp from the roll bar means.

21. The apparatus of claim 20 including: upwardly extended arcuate members located transversely over the top of the car to support the tarp in the closed position, means mounting the member on the sidewalls of the car, said biasing means comprising a tubular member secured to the members, a spring located within the tubular member, means to anchor one end of the spring on the tubular member, and cord means connecting the spring to the tarp whereby the spring biases the tarp toward the closed position thereof.

* * * * *